United States Patent [19]

Clearman et al.

[11] 4,397,163

[45] Aug. 9, 1983

[54] REDUCED ENERGY CONSUMPTION AUTOMATIC WASHERS

[75] Inventors: Jack F. Clearman, St. Joseph; Thomas H. Buckleitner, Lincoln Township, Berrien County, both of Mich.

[73] Assignee: Whirlpool Corporation, Benton Harbor, Mich.

[21] Appl. No.: 294,298

[22] Filed: Aug. 19, 1981

[51] Int. Cl.[3] ..... D06F 13/02

[52] U.S. Cl. ..... 68/53; 68/134

[58] Field of Search ..... 68/23.7, 53, 133, 134, 68/184

[56] References Cited

U.S. PATENT DOCUMENTS

| | | | |
|---|---|---|---|
| 2,642,733 | 6/1953 | McCormick | 68/134 |
| 2,909,051 | 10/1959 | Altorfer | 68/134 X |
| 3,022,655 | 2/1962 | Gerhardt | 68/18 FA |
| 3,091,954 | 6/1963 | Bullock | 68/18 FA |
| 3,145,553 | 8/1964 | McMillan | 68/18 FA |
| 3,352,130 | 11/1967 | Landwier | 68/53 X |
| 4,077,239 | 3/1978 | Platt et al. | 68/53 |
| 4,134,277 | 1/1979 | Platt et al. | 68/53 |

*Primary Examiner*—Philip R. Coe

*Attorney, Agent, or Firm*—Hill, Van Santen, Steadman, Chiara & Simpson

[57] ABSTRACT

A fluid pumping agitator for use in a vertical axis automatic clothes washing machine which pumps wash liquid from a central inlet communicating with the tub to an outlet communicating with the basket to reduce the volume of liquid required in a washing cycle. The agitator pumps liquid in both directions of its oscillatory rotational movement.

8 Claims, 4 Drawing Figures

REDUCED ENERGY CONSUMPTION AUTOMATIC WASHERS

BACKGROUND OF THE INVENTION

1. Field of the Invention

This invention relates to a washing machine having a liquid pumping agitator, and more particularly to a washing machine wherein wash liquid is pumped outwardly through the interior of the agitator during the wash cycle.

2. Description of the Prior Art

Various attempts have been made at pumping wash liquid through the agitator of an automatic washing machine during the washing cycle. U.S. Pat. No. 2,542,733 discloses a pumping agitator with a flapper valve at the inlet to ram water from peripheral inlets through a screen to a central outlet opening. An alternative embodiment discloses utilizing centrifugal force to pump water outwardly through the agitator from the upper portion of the barrel.

U.S. Pat. No. 2,909,051 discloses a wash liquid pumping agitator in which the agitator travels through an orbital path as opened to rotating about a center axis and within the interior of the agitator there is provided a positive displacement pump which has an expanding and contracting chamber integrally connected with a cam arrangement to force the wash liquid upwardly through the agitator. Check valves are provided to maintain the flow of wash liquid up through the agitator in one direction.

U.S. Pat. No. 3,022,655 discloses a valveless pumping agitator which utilizes four spiral portions to ram wash liquid through inlet openings 26 upwardly through the spiral passage to the barrel of the agitator when the agitator moves in the clockwise portion of an oscillatory movement.

U.S. Pat. No. 3,091,954 discloses a positive displacement piston pump utilizing a fixed check valve and a floating check valve to pump wash liquid upwardly through the agitator as the agitator moves up and down in a reciprocating motion.

U.S. Pat. No. 3,145,553 discloses a vaned positive displacement pump which utilizes two sets of check valves to provide the wash liquid flow upwardly through the agitator to an agitator mounted filter.

SUMMARY OF THE INVENTION

The greatest consumption of energy in conducting a laundering operation with a temperature conditioned liquid occurs in the pre-heating of the wash liquid. This step is usually performed outside the automatic washer appliance and is therefore beyond the control of a washer manufacturer. However, since the amount of energy required to heat the liquid is directly dependent on the volume of liquid required to perform the washing function, minimization of liquid volume without reduction in washability criteria is a desirable objective.

A number of washing machine constructions employ an imperforate tub which contains the washing liquid during the washing cycle and which also encloses a coaxially mounted spin basket. The spin basket has liquid communications with the tub such that during the spin cycle the wash liquid can be centrifugally forced from the basket to the tub and to a drain.

Because of the rotational movement of the basket within the tub, there is an annular clearance space provided between the basket and the tub. During the agitation cycle, the wash liquid level within the basket is required to be above the top of the clothes in the basket which can be and usually is near the top of the basket. In the normal operation of current washing machines, the wash liquid level within the annular space between the basket and tub is at the same level as that within the basket, that is, near the top of the basket.

The present invention provides a means for reducing the volume of wash liquid required to wash clothes in an automatic washer by pumping wash liquid from the annular space where it does not actively condition the clothes being laundered into the basket where it can be used. The inertia of the wash liquid assists the pumping action of the oscillating agitator to reduce the volume of water required, and thus the ultimate energy requirements.

In accordance with the present invention a wash liquid pumping agitator for an automatic washer is provided wherein the inertia of the wash liquid in the washer basket relative to the oscillatory movement of the agitator is used to force the wash liquid to follow a path from the central portion of the agitator, through channels in the skirt of the agitator to discharge from the periphery of the agitator. The channels in the agitator comprise annular channels around the skirt of the agitator having an inlet communicating with openings in the center post portion of the basket, which communicate with the annular space between the basket and the tub, and an outlet at the periphery of the agitator skirt. The basket has outlet openings communicating with the tub near the top of the basket.

The outer annular channel has a length which is approximately equal to the circumference of the agitator skirt which contains a large volume of liquid providing inertia relative to the rotational movement of the agitator such that during the agitation cycle there is sufficient inertia in the volume of water to supply an adequate pumping head to reduce the height of water between the basket and the tub. The outer annular channel in the skirt is divided into two semi-annular channels by a flapper valve means adjacent the outlet to retard the flow of wash liquid alternatively in half of the annular channel and to direct a constant flow of liquid through the outlet opening.

Thus, as the agitator rotates in a first direction, the relative movement between the agitator and the wash liquid within the annular channel is such so as to cause the wash liquid in a first half of the channel to move toward the flapper valve which directs it to exit through the outlet opening in the periphery of the skirt to return to the basket. As the agitator rotates in the reverse direction, the liquid in a second half of the channel moves toward the flapper valve and is directed out through the outlet opening. In either direction, the flapper valve retards the movement of liquid in the other half of the channel by closing the outlet to that half of the channel causing liquid to be drawn in through the inlet opening of the channel opposite the closed outlet.

DESCRIPTION OF THE PREFERRED EMBODIMENTS

Figure 1:
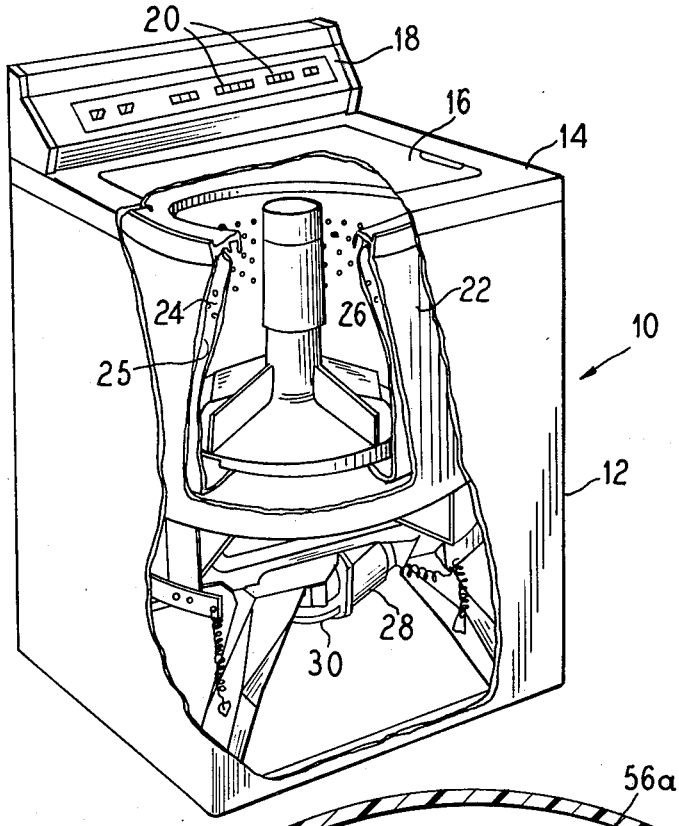
FIG. 1 is a perspective view of a washing machine embodying the present invention, partially cut away to show the interior mechanism thereof.

A laundry appliance 10 comprising an automatic clothes washer embodying the principles of the present invention is depicted in FIG. 1. The washer is comprised of a cabinet 12 having a top 14 with a lid 16 and a console 18 having presettable controls 20 thereon of the type wherein an operator may pre-select a program of automatic washing, rinsing and centrifuging steps in a laundering process. The lid 16 in the top 14 of the cabinet 12 may be opened to permit access into the top of an imperforate tub 22 housed within the cabinet 12. Enclosed by and supported coaxially within the tub 22 is a clothes container or a spin basket 24. An annular space 25 is provided between the basket 24 and the tub 22 to provide clearance during the spinning of the basket with the tub. An agitator 26 is oscillatably mounted within the basket 24.

Figure 2:
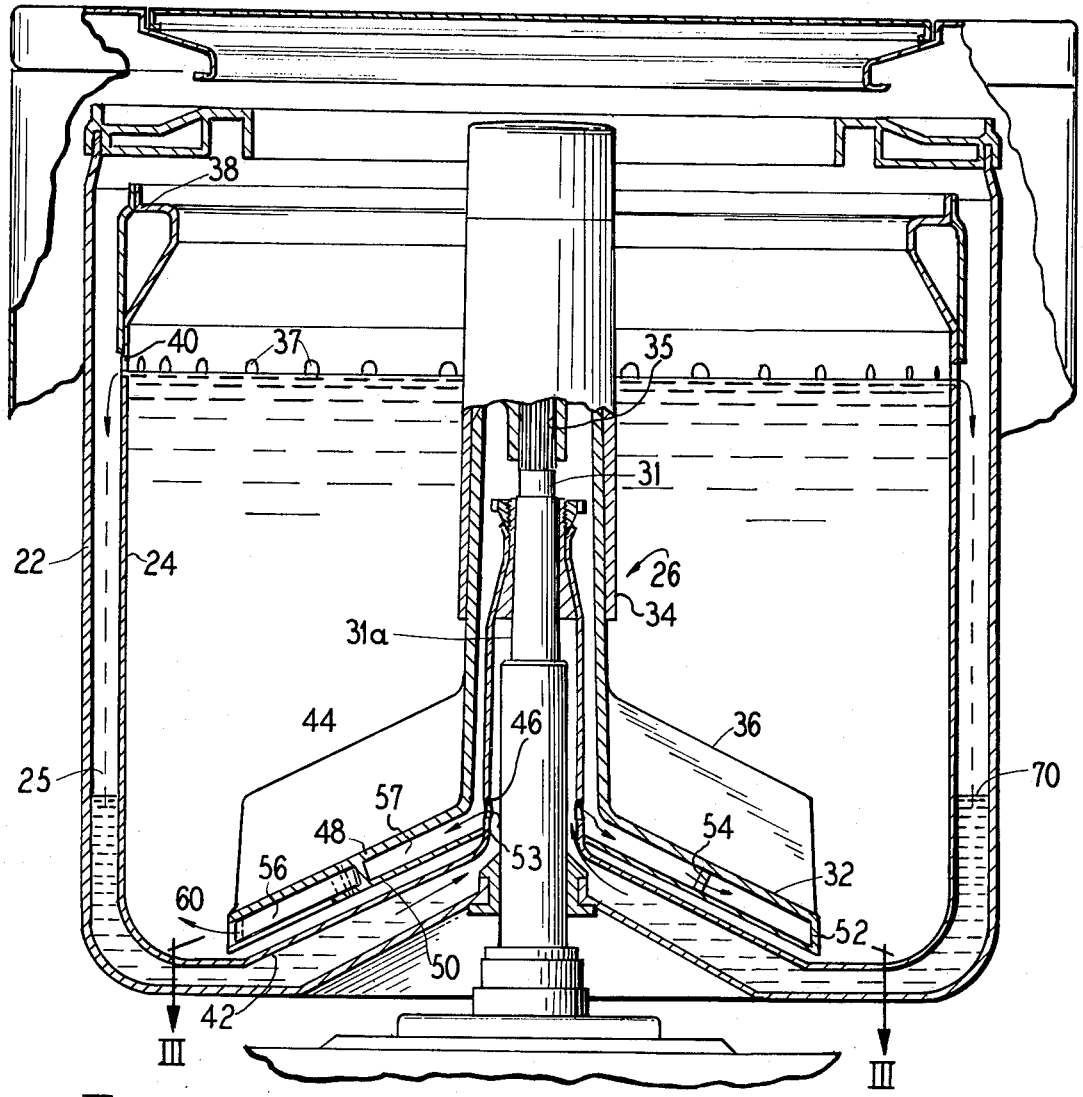
FIG. 2 is a side sectional view of the agitator assembly within the tub and basket of the washing machine.

Below the tub 22 but within the cabinet 12 there is provided an electric motor 28 which oscillatably drives the agitator 26 through a transmission 30 by means of a drive shaft 31 (FIG. 2). The agitator 26 is shown in greater detail in FIGS. 2 and 3 where it is seen that the agitator 26 is comprised of a skirt portion 32 near the bottom of the agitator and a substantially vertical barrel portion 34 integrally connected with the skirt and projecting upwardly therefrom. The shaft 31 is drivingly connected by splines to the agitator in the normal manner as shown at 35. A plurality of flexible vanes 36 are provided around the periphery of the barrel 34 and extend downwardly and outwardly along the skirt portion 32 of the agitator 26.

The basket 24 is relatively imperforate. However, a set of horizontally disposed outlet openings 37 is positioned near the top 38 of the outer wall 40 through which the excess liquid is returned to the tub 24 during the washing and spin dry cycles. A bottom wall 42 of the basket slopes upwardly in a cone shape to merge with a central cylindrical portion 44 drivenly connected to a spin tube 31*a* in a conventional manner. The spin tube 31*a* is driven in rotation by motor 28 through transmission 30 at high speed to provide a centrifuging of the clothes load during spin dry. Near the base of the cylindrical portion 44 there are provided a plurality of inlet openings 46 which communicate with the annular space 25.

Figure 3:
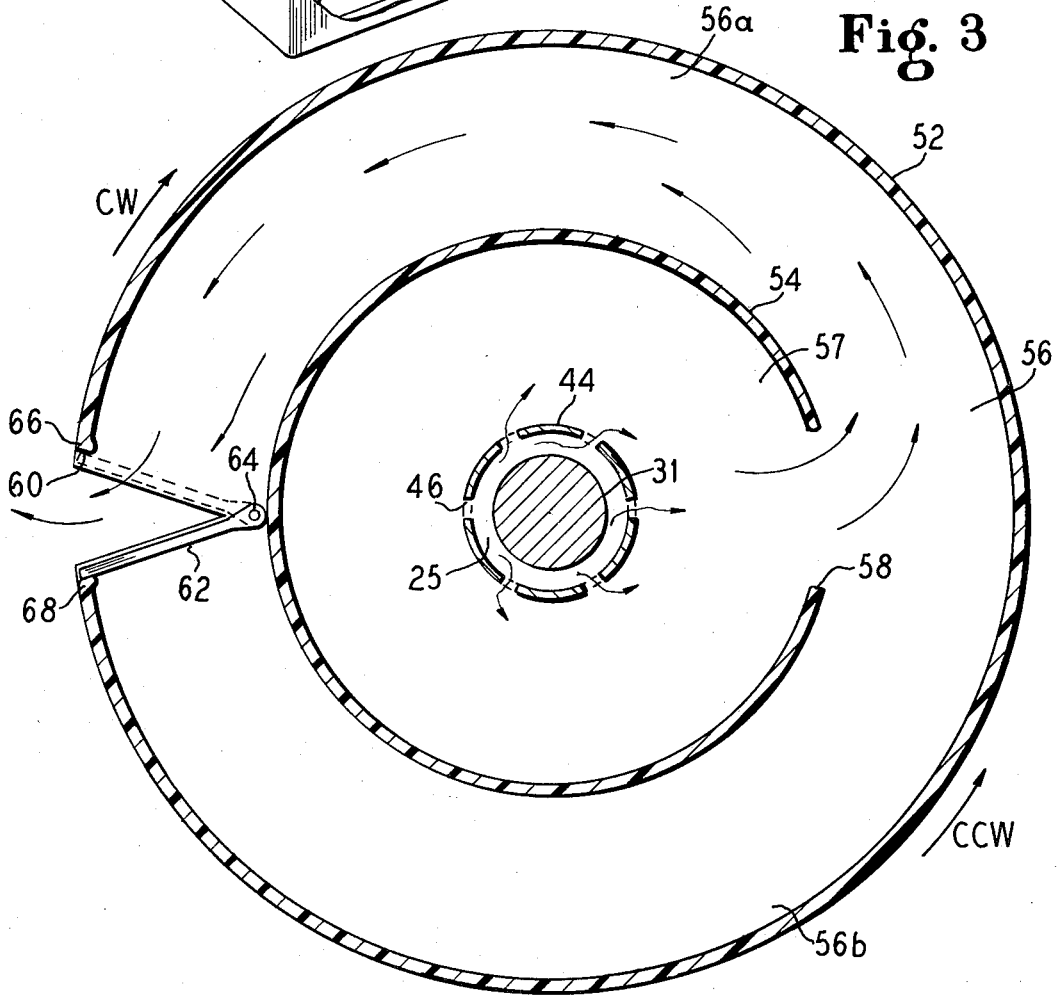
FIG. 3 is a sectional view of the agitator taken generally along the lines III—III of FIG. 2.
Figure 4:
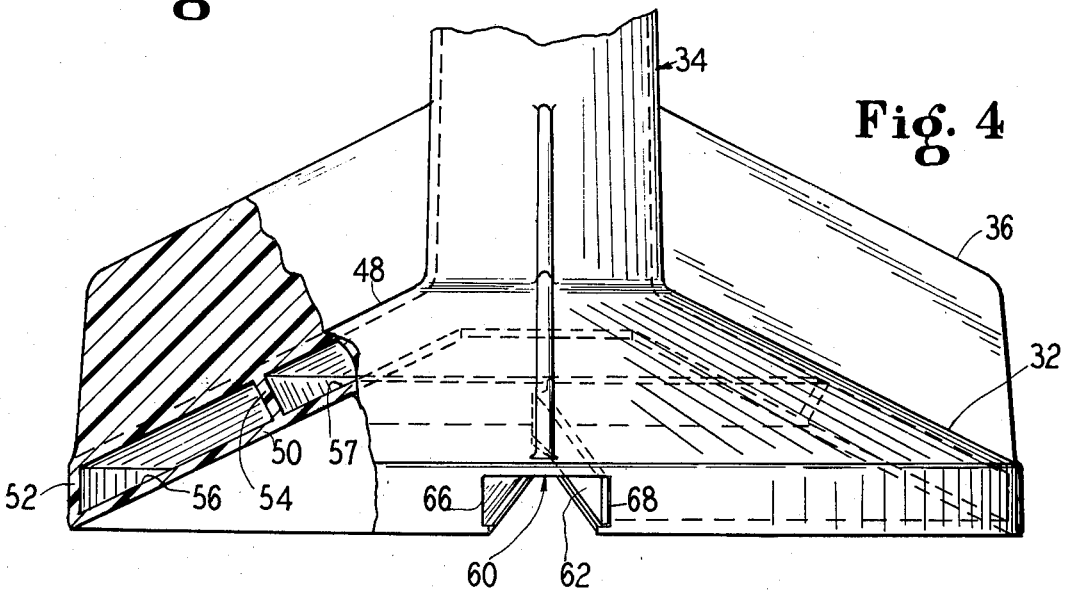
FIG. 4 is a partial side elevational view of the agitator partially cut away.

As seen in FIGS. 2, 3 and 4, the skirt portion 32 of the agitator 26 is of a two-wall construction having a top wall 48 and a spaced bottom wall 50 connected at the periphery of the skirt by a peripheral end wall 52. The bottom wall 50 extends inwardly to and seals against the cylindrical portion 44 as shown at 53. Extending between the top and bottom walls of the skirt there is provided a rib 54 approximately midway between the barrel 34 and the peripheral end wall 52 of the skirt 32.

The rib 54 defines two annular channels, outer channel 56 and inner channel 57. The outer channel 56 is adjacent to and extends around the periphery of the skirt 32. The inner channel 57 extends from the rib 54 radially inwardly and then upwardly around the cylindrical portion 44 of the basket. There is an inlet opening 58 to the outer channel 56 through the rib wall 54 in the skirt 32 to allow wash liquid to enter the annular outer channel 56 from the inner channel 57.

There is an outlet opening 60 from the outer channel 56 through the periphery wall 52 opposite the inlet opening 58 which provides communication between the outer annular channel 56 and the basket 24.

Thus, there are two flow paths between the inlet opening 58 and the outlet opening 60 through the outer annular channel 56. As seen in FIG. 3, the two paths are designated as 56*a*, the top half of the channel 56, and 56*b*, the bottom half of the channel 56.

A flapper valve means 62 is pivotally mounted at 64 adjacent the rib wall 54 and extends across the annular channel 56 to alternately abut against end walls 66, 68 of the outlet opening 60.

In this manner, the flapper valve means 62 alternately closes communication between the inlet opening 58 and the outlet opening 60 through one of the paths 56*a* or 56*b*.

Inlet openings 46 in the basket 24 are in liquid communication with the inner annular channel 57 providing a liquid path from the annular space 25 between the basket 24 and tub 22, through inlet openings 46 in the cylindrical portion 44 of the basket into the inner annular channel 57 in the skirt 32, through inlet opening 58 into the outer annular channel 56, through paths 56*a* and 56*b* and outlet opening 60 into the interior of the basket 24.

Periodically throughout the steps of the washing operation, the agitator is rotated in an oscillatory manner such that part of its rotation is in a clockwise direction as shown in FIG. 3 by arrow CW and another part of its rotation is in a counterclockwise direction as shown by arrow CCW. During this movement, there is a supply of wash liquid within the basket 24 which is generally above the level of the skirt portion 32 of the agitator 26 such that the wash liquid enters the inlet openings 46 and completely fills the inner channel 57 and the outer channel 56. As the agitator 26 oscillates, the agitator acts as a pump in the following manner.

As the agitator rotates in the clockwise direction as shown by arrow CW, the inertia of the wash liquid within the outer channel 56 tends to result in a relative rotational movement between the liquid and the agitator 26. In this manner the liquid in path 56*a* moves toward the outlet opening 60 pushing against flapper valve means 62 abutting it against end wall 68 of opening 60 as shown in FIG. 3 and closing off communication between path 56*b* and opening 60. The movement of the liquid in path 56*a* is retarded by the closing of the flapper valve means 62 and thus wash liquid is drawn into outer channel path 56*a* through inlet opening 58 to replace liquid which has been directed out through outlet opening 60 by the flapper valve means 62.

As the agitator 26 reverses its motion and begins rotating in a counterclockwise direction, as shown by arrow CCW, the inertia of the liquid causes it to flow in a reverse direction relative to the agitator which results in the liquid in channel path 56*b* flowing toward flapper valve means 62 abutting it against end wall 66 of opening 60. The movement of the liquid in path 56*a* is retarded by the closing of the flapper valve means 62 and thus wash liquid is drawn into outer channel path 56*b* through inlet opening 58 to replace liquid which has been directed through outlet opening 60.

Thus, the agitator pumps liquid outwardly in both rotational directions. The flapper valve means automatically responds to the change in oscillatory direction to direct the flow of liquid within the agitator. The pumping action lowers the level of liquid in annular space 25, as shown at 70 in FIG. 2, thereby reducing the volume of liquid required for the given water level in the basket 24 for the wash cycle and hence the amount of energy consumed during the wash cycle.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an automatic washer having a basket for receiving washing liquid and clothes therein, an agitator means within said basket for circulating said liquid, and a drive mechanism for driving said agitator in oscillatory motion, said agitator means comprising:

a vertical shaft extending into said basket, said shaft connected to said drive mechanism for oscillatory motion about a vertical axis;

a barrel portion surrounding and connected to an upper end of said shaft in driven relationship thereto;

an integral skirt portion connected to a lower end of said barrel portion having an annular channel in liquid communication with said basket through an outlet defined at an outer periphery of said skirt and at an inlet spaced along said annular channel from said outlet, said channel providing at least one passage from said inlet to sait outlet; and a valve means associated with said outlet and arranged to alternately open and close the outlet end of said passage whenever said agitator means is oscillated by said shaft, whereby liquid is circulated from said basket through said annular channel when said agitator is oscillated.

2. In the automatic washer of claim 1, said agitator including a second passage from said inlet to said outlet defined by said skirt portion, said valve means alternately closing the outlet end of each of said passages when said agitator is oscillated.

3. The device of claim 1, wherein said valve means comprises a flapper valve means pivotally mounted in said annular channel at said outlet.

4. In an automatic washer of the type having an oscillatory agitator, the improvement of:

pumping means comprising channel means in a skirt portion of said agitator forming an outward path through a skirt portion of said agitator through which liquid is to be pumped; and flapper means in said channel means below the level of liquid during operation and movably responsive to oscillation of the agitator, said channel means having abutment means on opposite sides of said flapper means and engageable therewith upon movement in opposite directions to form together with said flapper means a directing means for pumping liquid through said channel means.

5. The device of claim 4, wherein said channel means has a central inlet opening and a peripheral outlet opening and said flapper means is positioned at said outlet opening.

6. The device of claim 5, said agitator including a second channel means from said inlet to said outlet defined by said skirt portion, said flapper means alternately closing the outlet end of said channel means and said second channel means when said agitator is oscillated.

7. In a vertical axis washing machine having drive means for providing an oscillatory motion to a vertical agitator shaft, an imperforate tub for holding a supply of wash liquid during various steps of a washing cycle, a basket for containing clothes to be washed in said wash liquid, said basket rotatably mounted coaxially within said tub and having fluid communication with said tub through openings at a low central location and through openings at a high peripheral location, a liquid pumping agitator mounted for oscillatory movement by said shaft, said agitator comprising:

a vertical barrel drivenly connected to said shaft, a skirt integrally connected to a lower end of said barrel, said skirt defining an inner annular interior passage and an outer annular interior passage, said inner annular passage fluidly connected through said central openings in said basket to said tub, said outer annular passage fluidly connected through an outlet opening in said skirt to said basket, said inner and outer annular passages having means forming an opening therebetween spaced from said outlet opening in said skirt for providing fluid communication from said tub to said basket through said skirt, a flapper valve means pivotably mounted in said outer annular passage at said outlet opening in said skirt to alternately open and close said opening in response to the oscillatory motion of said agitator, whereby wash fluid is pumped from said tub to said basket through said skirt by the relative movement between said agitator and said liquid.

8. The device of claim 7, wherein said outer annular passage defines two paths between said inner annular passage and said outlet opening and said flapper valve means alternately closes the outlet end of each of said paths when said agitator is oscillated.

* * * * *

UNITED STATES PATENT AND TRADEMARK OFFICE

CERTIFICATE OF CORRECTION

PATENT NO. : 4,397,163

DATED : August 9, 1983

INVENTOR(S) : Jack F. Clearman et al.

It is certified that error appears in the above-identified patent and that said Letters Patent are hereby corrected as shown below:

Column 5, claim 1, line 13, before "outlet" delete "sait" and insert --said--.

Signed and Sealed this

*Fifteenth* Day of *November 1983*

[SEAL]

*Attest:*

GERALD J. MOSSINGHOFF

*Attesting Officer*

*Commissioner of Patents and Trademarks*